United States Patent [19]

Freisinger et al.

[11] Patent Number: 4,779,891

[45] Date of Patent: Oct. 25, 1988

[54] SAFETY SKI BINDING

[75] Inventors: Henry Freisinger; Karl Stritzl, both of Vienna, Austria

[73] Assignee: TMC Corporation, Switzerland

[21] Appl. No.: 87,302

[22] Filed: Aug. 20, 1987

[30] Foreign Application Priority Data

Aug. 22, 1986 [AT] Austria ..... 2273/86

[51] Int. Cl.[4] ..... A63C 9/085

[52] U.S. Cl. ..... 280/625; 280/629

[58] Field of Search ..... 280/625, 626, 629, 631, 280/632, 611

[56] References Cited

U.S. PATENT DOCUMENTS 4,434,997 3/1984 Nitschko ..... 280/625
4,533,156 8/1985 Gertsch ..... 280/629

FOREIGN PATENT DOCUMENTS 294645 11/1971 Austria .
383044 5/1987 Austria .
1960002 6/1970 Fed. Rep. of Germany ..... 280/629
3403472 8/1985 Fed. Rep. of Germany .

*Primary Examiner*—John J. Love
*Assistant Examiner*—Michael Mar
*Attorney, Agent, or Firm*—Finnegan, Henderson, Farabow, Garrett and Dunner

[57] ABSTRACT

The safety ski binding comprises a base plate on which a spring housing for a release spring is mounted for displacement transversely on the longitudinal direction of the ski. Mounted in the spring housing are two hinged jaws laterally engaging a ski boot and rotatably supported about vertical axes.

For improving the retention of the ski boot and for facilitating the lateral release in the case of a rearward torsion fall, a U-shaped pivot member is mounted on a transverse axial member in the spring housing and supports a further transverse axial member supporting a catch lever subjected to the action of the release spring to be engaged with a nose of a clamp retainer rotatably mounted about another transverse axial member, which suppports a sole clamp.

9 Claims, 4 Drawing Sheets

SAFETY SKI BINDING

BACKGROUND OF THE INVENTION

The present invention relates to a safety ski binding and, in particular, a ski binding for securely retaining a ski boot, while affording lateral displacement in response to a fall by a skier.

A ski binding of this type is generally described in Austrian Patent Publication No. AT-B-383,044. This conventional ski binding suffers from the disadvantage that the ski boot sole is only held from lateral movement by a pair of hinged jaws adapted to open only in response to a torsion fall of the skier, but not in the case of a rearward torsion fall of the skier, such as when the front of the boot is twisted and lifted.

Another type of a ski binding is described in German Patent Publication DE-A1 34 03 472. This ski binding has a housing securely bolted to the top surface of the ski and containing a four-hinge linkage consisting of two crank levers and a connecting link. Hinged jaws are rotatably mounted on the hinge axes of the connecting link. The manner in which the hinged jaws are locked and the four-hinge linkage is retained in its normal position is not described in this publication. Instead, the objective of the ski binding disclosed in DE-A1 34 03 472 is to prevent an increase of friction in the front jaw assembly in the case of a forward or rearward torsion fall.

The concept of employing, in a safety ski binding, a jaw assembly which may be selectively mounted as a front or rear jaw assembly is generally known in the art, as indicated in Austrian Patent Publication No. AT-B-294,645. This publication discloses a jaw assembly having a sole clamp designed to grip the ski boot laterally and retain the ski boot in a centered position by a release mechanism biased against lateral and vertical release by a single spring. For releasing the ski boot, the jaw assembly is rotated about a vertical member fixedly connected to the base plate, and also about a transverse axis. The ski binding disclosed in this publication lacks a step plate, however, which would be mounted on the base plate for transverse displacement relative to the longitudinal direction of the ski.

SUMMARY OF THE INVENTION

It is an object of the present invention to eliminate the above-noted disadvantages and to provide a ski binding in which the sole of the ski boot is retained not only by laterally displaceable hinged jaws, but also by a sole clamp adapted to be raised slightly above the top of the ski to faciliate lateral release of the ski boot, when the boot is lifted and twisted when the skier falls backward.

To achieve the foregoing objects and in accordance with the purposes of the invention, as embodied and broadly described herein, a safety ski binding, particularly a front clamp, comprises a base plate on which a step plate carrying a spring housing for a release spring may be displaced transverse to the longitudinal direction of the ski against the action of the release spring, a pair of hinged jaws laterally engaging a ski boot being mounted in said spring housing for rotation about vertical axes, wherein a pivot member having a U-shaped configuration as seen in the direction of the longitudinal axis of the building is mounted in the spring housing for rotation about a transverse axis or axle stub, the pivot member connected to a further transverse member supporting a catch lever engaged by a piston and biased by the release spring, the catch lever engaging a nose of a clamp retainer having a U-shaped configuration in top plan view, the clamp retainer being mounted for rotation about another transverse axial member and carrying a sole clamp.

As embodied herein, the release spring satisfies a dual function, namely, to hold the step plate and the spring housing in a centered position on the ski, while biasing the sole clamp downward into engagement with the ski boot sole through the catch lever which is hinged to the pivot member. If the sole clamp is biased upward by a rearward inclination of the skier without the occurrence of a fall, the release spring in the spring housing is relieved to a certain degree. A rearward torsion fall of the skier, however, causes the sole clamp to be lifted.

As embodied herein, retention of the spring housing and the step plate in a centered position is accomplished by means of the release spring acting on the piston. Preferably, a sudden rearwardly twisting fall of a skier will cause the catch lever to exert a force acting in the direction towards the ski boot along its respective transverse axis, so that the pivot member exerts a pressure on the cam disk. As a result, the control system of the front jaw assembly retains a residual force sufficient to ensure that the ski boot continues to be centered.

As embodied herein, the catch lever is disposed between legs of the pivot member, while a transverse member supporting the pivot member is disposed in the spring housing, which is above a bore for housing the release spring. Alternatively, the transverse member may be disposed below a bore housing and the release spring may be disposed at a location which is between a stop fixedly secured along the ski and the end of the ski toward the ski tip.

The accompanying drawings, which are incorporated in and constitute part of this specification, illustrate at least one embodiment of the invention and, together with the description, serve to explain the principles of the invention.

DESCRIPTION OF THE PREFERRED EMBODIMENT

Reference will now be made to the present preferred embodiments of the invention, examples of which are illustrated in the accompanying drawings.

Figure 1:
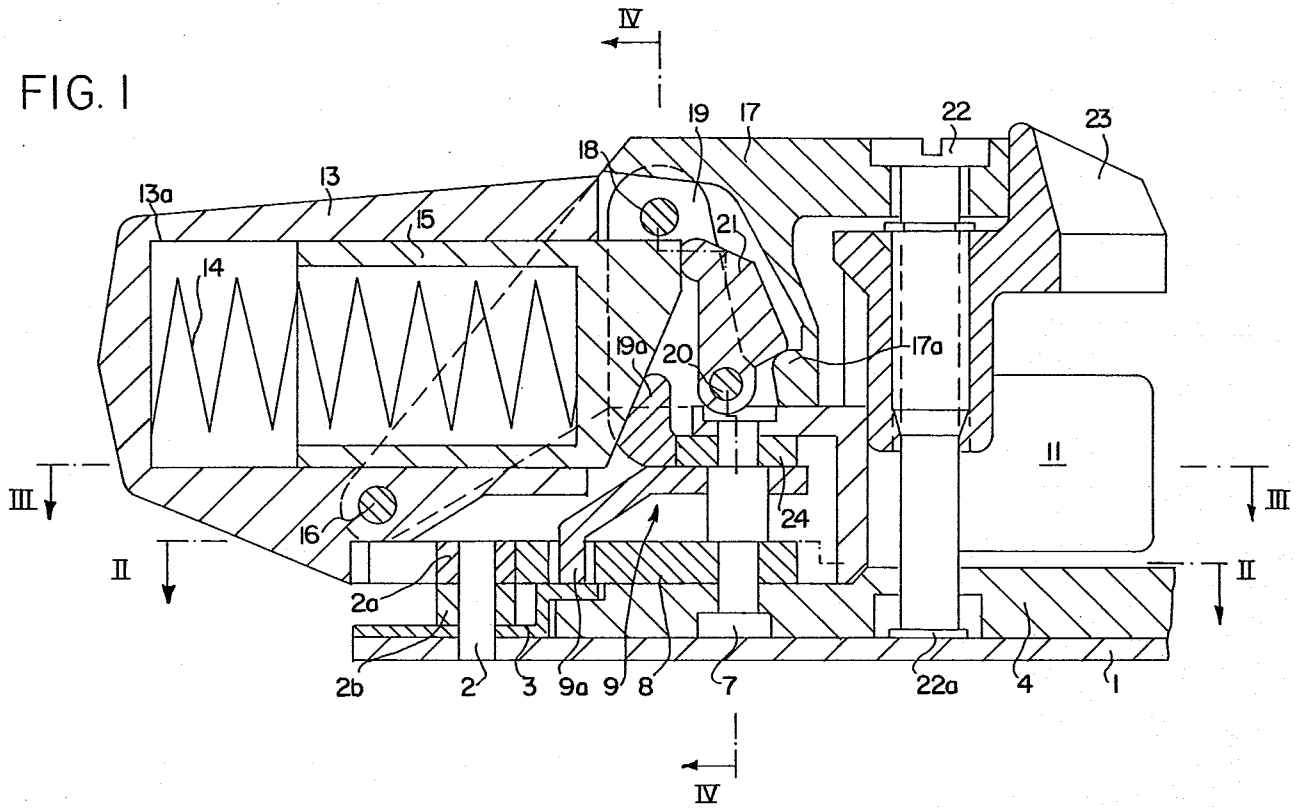
FIG. 1 shows a side sectional view of a front jaw assembly according to the present invention taken along the center of the ski, as viewed in an operational mode during skiing.

In accordance with the present invention and as shown in FIG. 1, safety ski binding includes a base plate 1 secured to a ski (not shown), the base plate 1 having a forward portion supporting a stud 2, which extends perpendicular to the ski surface. The stud 2 is fixed in the base plate 1, such as by a press seat in a bore (not shown) of the base plate 1. The stud 2 includes a roller 2*a* mounted thereon together with a spacer bush 2*b*. Disposed below the spacer bush 2*b* is a profile member 3 for guiding a step plate 4 in the longitudinal direction of the ski. The step plate 4 is arranged parallel to the surface. The profile member 3 is secured to the ski together with base plate 1 by means of screws 3*a*. Step plate 4 is connected to base plate 1 by a pair of links 5 and 6 through studs 5*a* and 6*a*. Alternatively, a second profile member may be provided in place of links 5 and 6 for guiding the step plate 4 in the transverse direction of the ski.

In accordance with the invention, the ski binding comprises first clamping means responsive to an actuating force for restricting movement along with step plate 4 substantially transverse to a longitudinal axis of the base plate 1. As embodied herein, the first clamping means includes a shaft 6 rotatably mounted in the step plate 4 and secured therein against axial displacement. The front end of the step plate 4 supports a control plate 8 secured to the shaft 7. A front end of the control plate 8 is formed as a fork for engaging the roller 2*a*. Mounted on shaft 7 at a spaced location from control plate 8 is control disk 9 supporting a control lever 9*a*. The control disk 9 is rotatable about shaft 7 and extends parallel to control plate 8, the free end of control lever 9*a* being angled downward at a right angle to the control disk 9.

Figure 2:
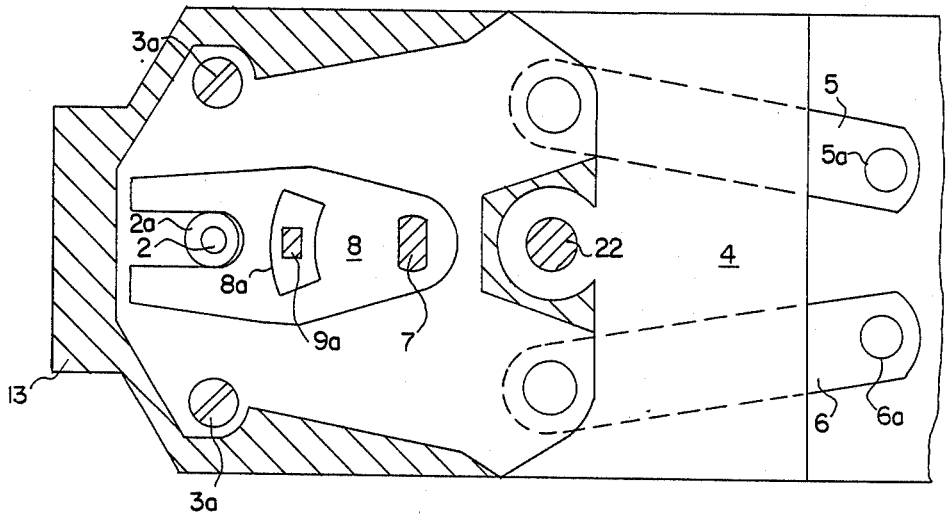
FIG. 2 shows a top sectional view taken along line II—II in FIG. 1.
Figure 3:
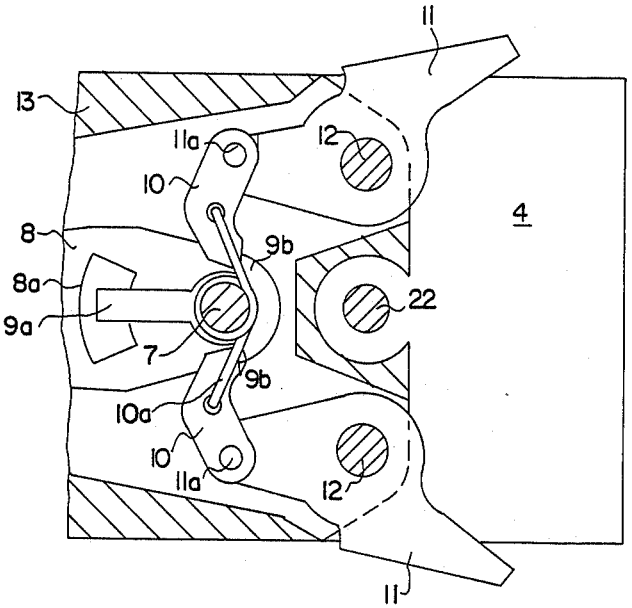
FIG. 3 shows another top sectional view taken along line III—III in FIG. 1.
Figure 5:
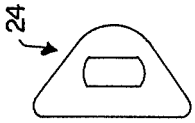
FIG. 5 shows a top plan view of an element part of the jaw assembly.
Figure 4:
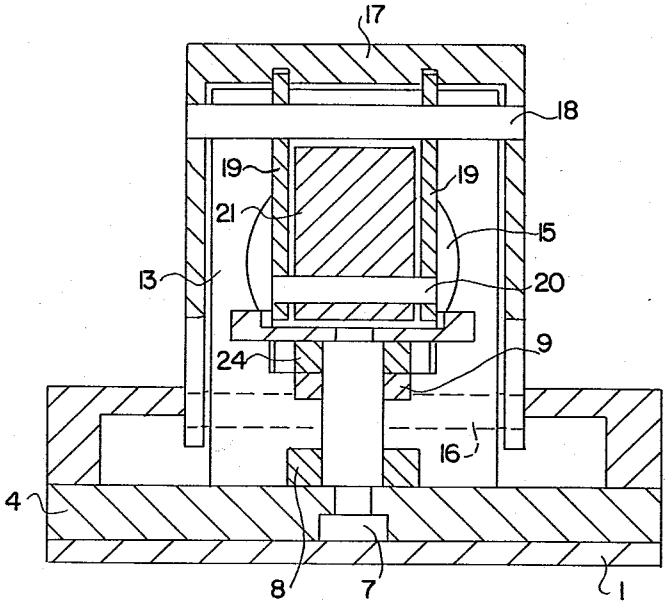
FIG. 4 shows a vertical section of the front jaw assembly taken along the line IV—IV in FIG. 1.
Figure 6:
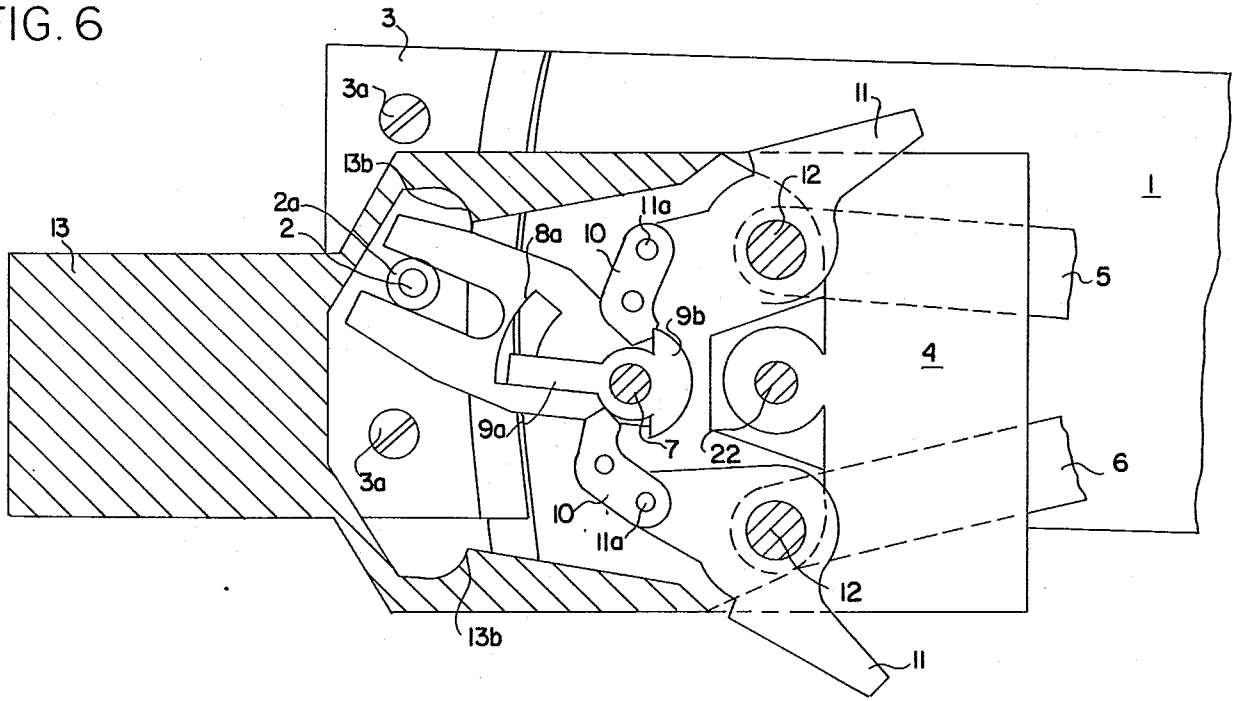
FIG. 6 shows a top sectional view substantially corresponding to FIG. 3 and depicting the jaw assembly after a torsion fall (a spring connecting the two support members to one another having been omitted for the sake of clarity).

FIGS. 1–3 illustrate that the free end of control lever 9*a* is slidably received within an arcuate slot 8*a* formed in the control plate 8. As shon in FIG. 3, the portion of control disk 9 adjacent shaft 7 is formed with two stops 9*b* engaged by a pair of support members (links) 10 which are biased by a spring 10*a* (FIG. 6). Support members 10 are pivotally connected to a pair of hinged jaws 11 mounted for rotation about respective axial members 12 extending within a spring housing 13 secured to a front portion of the step plate 4. Each support member 10 is mounted on its respective hinged jaw 11 by a pin 11*a*.

In accordance with the invention, the ski binding comprises tension means mounted on the step plate 4 for generating the actuating force. As embodied herein and shown principally in FIG. 1, the tension means includes the spring housing 13 formed with a bore 13*a* and extending in the longitudinal direction of the ski to house a release spring 14. The actuating force of the release spring 14 is adapted to be adjusted in a conventional manner with the aid of an adjustment marking (not shown) which cooperates with a graduated scale provided on the spring housing. An end of the release spring 14 facing away from the ski tip is supported by a piston 15. Extending through the spring housing 13 and disposed below the bore 13*a* is a transversely extending axial member 16 supporting a clamp retainer 17 of U-shaped configuration as viewed along the longitudinal direction of the ski. The legs of the clamp retainer 17 are guided in slots of the spring housing 13. Above the bore 13*a* there is another transverse axial member 18 carrying a pivot member 19 also having a U-shaped configuration, as viewed along the longitudinal direction of the ski. Disposed between the legs of pivot member 19 there is a further transverse axis 20 for a catch lever 21. Under the biasing force of the release spring 14, piston 15 acts on catch lever 21 to engage it with a nose 17*a* of the clamp retainer 17.

In accordance with the invention, the ski binding comprises second clamping means engaged with the tension means and responsive to the actuating force for the restricting movement in a substantially perpendicular direction away from the step plate 4. As embodied herein, the second clamping means includes a screw 22 extending perpendicular to the ski surface, the screw 22 being rotatably mounted in the clamp retainer 17 and secured therein against axial displacement. The screw 22 is in threaded engagement with a sole clamp 23. A lower end portion of screw 22 extends through a bore in the step plate 4 and into an open recess formed in the underside thereof, to terminate in a flange 22*a* effective to limit the vertical displacement of the screw 22 and thus the sole clamp 23.

Further, as embodied herein, the ski binding includes a cam disk 24 secured to shaft 7 above the control disk 9. A transverse portion 19*a* of the pivot member 19 is supported on the cam disk 24 when the ski binding is in normal use.

In the operation of the present invention, the ski boot (not shown) is held against lateral movement by the two hinged jaws 11, while being held against vertical displacement by the sole clamp 23. In the event of a pure torsion fall by the skier in which the boot is twisted, the step plate 4 and thus spring housing 13 are displace transversely of the vertical longitudinal center plane of the ski.

As shown in FIG. 6, the transverse movement between the step plate 4 and the base plate 1 is limited in the engagement of the control plate 8 with an edge 13*b* of the spring housing 13. The resultant displacement causes the control lever 9*a* to come into engagement with one end of the arcuate slot 8*a* in control plate 8, enabling the control lever 9*a* to be entrained thereby. At the same time, the cam disk 24 acts on transverse portion 19*a* of pivot member 19 to push piston 15 by a small distance back into bore 13*a* of the spring housing 13. When the transverse displacement of step plate 4 or spring housing 13, respectively, attains a given magnitude, support member 10 of one hinged jaw 11 is pivoted by the associated stop 9*b* of control disk 9, so that the respective hinged jaw 11 is released.

If on the other hand a sudden, rearward torsion fall is experienced by the skier, the sole clamp 23 will be lifted additionally by an amount limited by the depth of the recess in step plate 4. At the same time, catch lever 21 exerts a force on its transverse axis 20 acting in the direction towards the ski boot, whereby transverse portion 19*a* of pivot member 19 is caused to exert a pressure on the cam disk 24. As a result, the control system of the front jaw assembly retains a residual force effective to hold the ski boot at its centered position as before.

It will be apparent to those skilled in the art that modifications and variations can be made in the ski binding of the present invention without departing from the scope or spirit of the present invention. For example, the ski binding may include an embodiment in which the distance the step plate is displaced in the event of a torsion fall is limited by stops. In another embodiment, each support member 10 may be biased by a separate spring. Therefore, it is intended that the present invention cover modifications and variations provided they come within the scope of the appended claims and their equivalents.

What is claimed is:

1. A frontal portion of a safety ski for securing a ski boot to a ski, said ski binding comprising binding comprising:

an elongated base plate having a longitudinal axis;

a step plate slidably supported along said base plate;

restraining means for limiting movement of said step plate relative to said base plate;

tension means disposed along said step plate for generating an actuating force, said tension means including a housing mounted on said step plate and defining a bore, and a piston member slidably mounted within said bore and having engagement means disposed on an outer and surface of said piston member, said tension means for urging said piston member out of said bore;

first clamping means engaged with said tension means and responsive to said actuating force for restricting movement of the ski boot along said step plate in a direction substantially transverse to said longitudinal axis, said first clamping means including hinged jaws aligned along said step plate and control means mounted on said step plate and engaged with said engagement means for controlling said actuating force applied to said hinged jaws; and for urging said piston member into said bore; and second clamping means engaged with said tension means and responsive to said actuating force for restricting movement of the ski boot in a substantially perpendicular direction away from said step plate, said second clamping means including a clamp retainer rotatably mounted on said housing, a sole clamp adjustably connected to said clamp retainer, and lever means pivotally connected to said clamp retainer and engaged between said engagement means and said clamp retainer for controlling said actuating force applied to said sole clamp.

2. The frontal portion of the safety ski binding defined in claim 1, wherein said engagement means includes a first surface for engaging said control means and a second surface for engaging said lever means.

3. The frontal portion of the safety ski binding defined in claim 2, wherein said control means include:

roller means adapted to be secured to said base plate on said longitudinal axis;

a control shaft secured to said step plate;

a control plate rotatably mounted on said shaft adjacent said step plate, said control plate having an arcuate slot and a forked end engaged with said roller means;

a control disk rotatably mounted on said control shaft and having a control lever slidably positioned within said arcuate slot;

cam means secured to said control shaft;

a pivot member pivotally mounted on said clamp retainer; and a transverse member fixedly disposed along said pivot member for engagement with said first surface and said cam means, wherein transverse displacement of said step plate relative to said longitudinal axis urges said control lever against an end wall of said arcuate slot, pivots said control plate about said roller means, and rotates said cam means against said actuating force, said hinged jaws being outwardly pivoted by transverse displacement of said step plate exceeding a predetermined level.

4. The frontal portion of the safety ski binding defined in claim 3, wherein said clamp retainer includes a pair of legs having U-shaped configuration, said pivot member being disposed between said legs.

5. The frontal portion of the safety ski binding defined in claim 3, wherein said lever means includes a catch lever pivotally mounted on said pivot member, said clamp retainer having a nose projection for engagement with said catch lever.

6. The frontal portion of the safety ski binding defined in claim 3, wherein said control means includes support links each pivotally connected to respective ones of said hinged jaws and biasing means extending between each of said support links and said control shaft.

7. The frontal portion of the safety ski binding defined in claim 3, wherein said control disk includes stops for engagement with said support links to hold said support links against continued pivotal movement.

8. The frontal portion of the safety ski binding defined in claim 1, wherein said restraining means includes a profile member for defining the position of said step plate in a substantially perpendicular direction away from said base plate and screw means for securing said profile member to said base plate.

9. The frontal portion of the safety ski binding defined in claim 1, wherein said restraining means also includes an edge surface on said spring housing for limiting the movement of said step plate transverse to said longitudinal axis.

* * * * *